US005131349A

United States Patent [19]

Keller et al.

[11] Patent Number: 5,131,349

[45] Date of Patent: Jul. 21, 1992

[54] APPLICATION OF PRIMER COATING

[75] Inventors: Thomas A. Keller, Perrysburg; Wallace F. Krueger, Toledo; Robert J. Sloma, Perrysburg, all of Ohio

[73] Assignee: Libbey-Owens-Ford Co., Toledo, Ohio

[21] Appl. No.: 504,948

[22] Filed: Apr. 5, 1990

[51] Int. Cl.[5] ..... B05C 1/02; B05C 1/06; B05C 1/16

[52] U.S. Cl. ..... 118/73; 118/203; 118/216; 118/266; 156/578; 401/86; 401/188 R; 401/193; 401/207; 401/261

[58] Field of Search ..... 118/73, 203, 264, 266, 118/216, 217, 410; 156/107, 578; 401/207, 261, 266, 86, 130, 139, 188 R, 193

[56] References Cited

U.S. PATENT DOCUMENTS

| | | | |
|---|---|---|---|
| 3,071,106 | 1/1963 | Burelbach et al. | 118/410 X |
| 3,974,011 | 8/1976 | Jarchow et al. | 156/107 |
| 4,660,501 | 4/1987 | Nagata et al. | 118/266 X |
| 4,747,720 | 5/1988 | Bellehumeur et al. | 401/207 X |
| 4,790,259 | 12/1988 | Morris et al. | 118/266 X |
| 4,881,563 | 11/1989 | Christian | 118/302 |
| 4,947,580 | 8/1990 | Moore | 401/193 |

*Primary Examiner*—Michael G. Wityshyn
*Attorney, Agent, or Firm*—Marshall & Melhorn

[57] ABSTRACT

A system for applying a uniform band of liquid primer material to the marginal edge surfaces of glazing units upon which a plastic frame or gasket member is to be molded in place. A family of interchangeable applicator tips is provided for use with a dispensing device adapted to provide an on-demand supply of primer material to the tip in use. The different applicator tips of the family have configurations particularly adapted to applying bands of primer material along selected peripheral margins of a sheet member. Each is of a composite construction including a relatively rigid base member covered by a soft absorbent body for contacting and transferring to the sheet surface the layer of primer material. The tips are readily attachable to and removable from the primer material dispensing device. The dispensing device may comprise one or more applicator guns incorporated in a modular work station, including a closed storage and supply container for the primer material and a solvent flush system for cleaning hoses and flow guns of the reactive priming resins. The flow guns may be mounted upon an oscillating carriage whereby, in one position of the carriage, spent applicator tips are removed and replaced by new tips by a suitably programmed robot, and in another position the marginal edges of sheet members are moved along and through the applicator tips by a suitably programmed robot arm for application of a band of the primer material.

22 Claims, 3 Drawing Sheets

APPLICATION OF PRIMER COATING

BACKGROUND OF THE INVENTION

1. Field of the Invention

This invention pertains generally to application of a priming compound to a surface, and more particularly to application of a primer for the pretreatment of surfaces upon which an elastomeric gasket is to be molded in situ and adhered to the primed surface.

2. Description of the Prior Art

The invention is particularly adapted for the production of glazing units or window assemblies for automotive vehicles, although it will find utility generally in a great many other fields. Installation of fixed window units in earlier automotive vehicles generally involved manual installation of the glazing unit using suitable mechanical fasteners such as metal clips for securing the unit in the vehicle body, applying sealant around the marginal edges of the glazing unit, and positioning decorative trim strips around the unit to cover the junction between the marginal edges of the glazing unit and the adjacent portions of the vehicle body. Assembly and installation of such units was relatively slow and costly inasmuch as a considerable amount of labor was required. The procedure was not readily adaptable to being speeded up to accommodate increased automobile production line rates, nor was it adapted to being automated.

Efforts to overcome these disadvantages resulted in numerous improved window structures. Thus, unitary window assemblies were developed wherein a sheet of glass was provided with an adjacent peripheral frame, with a casing or gasket of molded material extending between the frame and the peripheral margin of the window to hold the glass sheet within the frame. Fasteners provided at spaced locations along the frame permitted the entire assembly to be guided into position over an appropriate opening in a vehicle and secured to the vehicle as a unit. Such unitary window units reduce the time required and simplify installation in the vehicle opening. However, due to the labor required in manually assembling the frame and gasket on the sheet of glass, the structures are relatively costly.

More recently, in order to eliminate the manual assembly, so-called encapsulated glazing units have been developed wherein individual sheets of glass or laminated glass units are formed with integral frame or gasket members molded and cured in situ by a reaction injection molding (RIM) process. One such process and resulting product is shown and described in U.S. Pat. No. 4,561,625 to Weaver commonly assigned with the instant application. Such encapsulating glazing units can be fabricated with a minimum of hand labor, and the resulting units can be readily attached to the portions of the vehicle body defining the window openings during assembly of the vehicle.

As described in the aforementioned patent, such encapsulated units are fabricated by disposing a predetermined portion of the marginal periphery of a sheet of transparent material within a mold structure. A polymeric gasket forming material is injected into the mold cavity and cured in situ on the sheet to encapsulate the marginal peripheral edge portion of the sheet. The resulting assembly can then be readily attached to the body portion defining the periphery of a window opening during manufacture and assembly of a vehicle.

Due to the nature of the glass surfaces, it is known that the gasket materials may not form a permanent, long term bond directly to the glass. Thus, they may not maintain adhesion to the glass surface for a length of time consistent with the life of the automobile. Exposure to weather moisture and sunlight, as well as other factors, may cause the gasket material to loosen from the glass with the passage of time, and ultimately to separate entirely from the glass. In order to improve the adherence of the gasket material to the glass and increase the service life of the encapsulated units to an acceptable level, it has been common practice to apply a coating of a liquid primer material to the affected surface of the glass prior to formation of the gasket thereon. Heretofore, this has been accomplished as by manually painting a band of the primer material along the appropriate edge portion of the glass panel. Such a procedure may, for example, utilize a brush periodically dipped in a container of the primer material, or a plastic squeeze bottle containing the primer material and having a suitable dispensing tip. In any event, the procedures are not entirely satisfactory in that they are time-consuming, labor-intensive and may not result in a satisfactory coating of the primer material. Thus the primer layer, which is generally a urethane material, should be applied as a uniform, continuous, relatively thin band in order to function properly. Should the layer be of excessive thickness, it may separate within the layer along a cleavage plane, resulting in failure of the bond. Of course, if the layer is not of sufficient thickness or if certain areas are not coated, the primer layer would likewise be ineffective for its intended purpose. The primer, and particularly the solvent therefore, may be toxic in nature so that manual application thereof, particularly when using an open container of the primer, may require use of protective equipment by the workers. Such manual application procedures also generally result in waste of the primer material and generally messy conditions in the work place. Due to the difficulty in controlling the width of manually applied bands, it may also be necessary to mask the workpiece prior to application of the primer material.

Thus, as will be readily apparent, the existing procedures for applying primer material to the edges of sheet material are not entirely satisfactory, and there is a need for a system for efficiently applying a band of primer of a desired uniform thickness and width to such sheet material.

SUMMARY OF THE INVENTION

In accordance with the present invention, there is provided a system for applying a uniform band of primer composition along selected portions of the peripheral margin of sheet material such as glazing units or the like. The band may be applied to either or both marginal surfaces, as well as to the edge portion and to interior marginal surfaces of spaced adjacent sheets where desired. The invention has particular utility in applying such bands of primer composition to the marginal edges of glazing unit upon which a plastic frame or gasket member is to be molded in place. However, as will be readily appreciated, it may as well be utilized for application of bands of liquid material in general to any suitable marginal surface.

A family of interchangeable applicator tips is provided for use with a dispenser adapted to provide an on-demand supply of primer compound to the tip in use. The different applicator tips of the family have configurations particularly adapted to applying bands of primer compound along selected peripheral margins of a sheet member, and each is of composite construction including a relatively rigid wicking base member to which is bonded a soft absorbent body for contacting and transferring to the sheet surface the layer of primer compound. The tips are readily attachable to and removable from a flow gun or other dispensing unit such as a squeeze bottle providing a supply of the primer compound. The flow gun, or a plurality of the flow guns, may be incorporated in a modular work station including a closed storage and supply container for the primer compound and a solvent flush system for cleaning hoses and flow guns of the reactive priming resins. The flow guns may also be mounted upon an oscillating carriage whereby in one position of the carriage, spent applicator tips are removed and replaced by new tips by a robot, and in another position the marginal edges of glazing units are moved through the applicator tips by a robot arm for application of a band of the priming compound.

It is accordingly an object of the invention to provide a device for applying a uniform band of primer material to selected peripheral marginal areas of a sheet member.

Another object of the invention is to provide such a device which minimizes waste of the primer material.

Another object of the invention is to provide such a device which is adapted to apply a primer material along the peripheral margin of either or both major surfaces of the sheet member, the edges thereof, and the interior peripheral margins of a pair of spaced sheet members.

Still another object of the invention is to provide such a device requiring a minimum of manual labor in its operation.

Yet another object of the invention is to provide such a device utilizing a closed supply system so as to minimize escape of solvent materials at the work station.

Other objects and advantages of the invention will become more apparent during the course of the following description, when taken in connection with the accompanying drawings.

BRIEF DESCRIPTION OF THE DRAWINGS

In the drawings, wherein like numerals are employed to designate like parts throughout the same.

DESCRIPTION OF THE PREFERRED EMBODIMENTS

Figure 1:
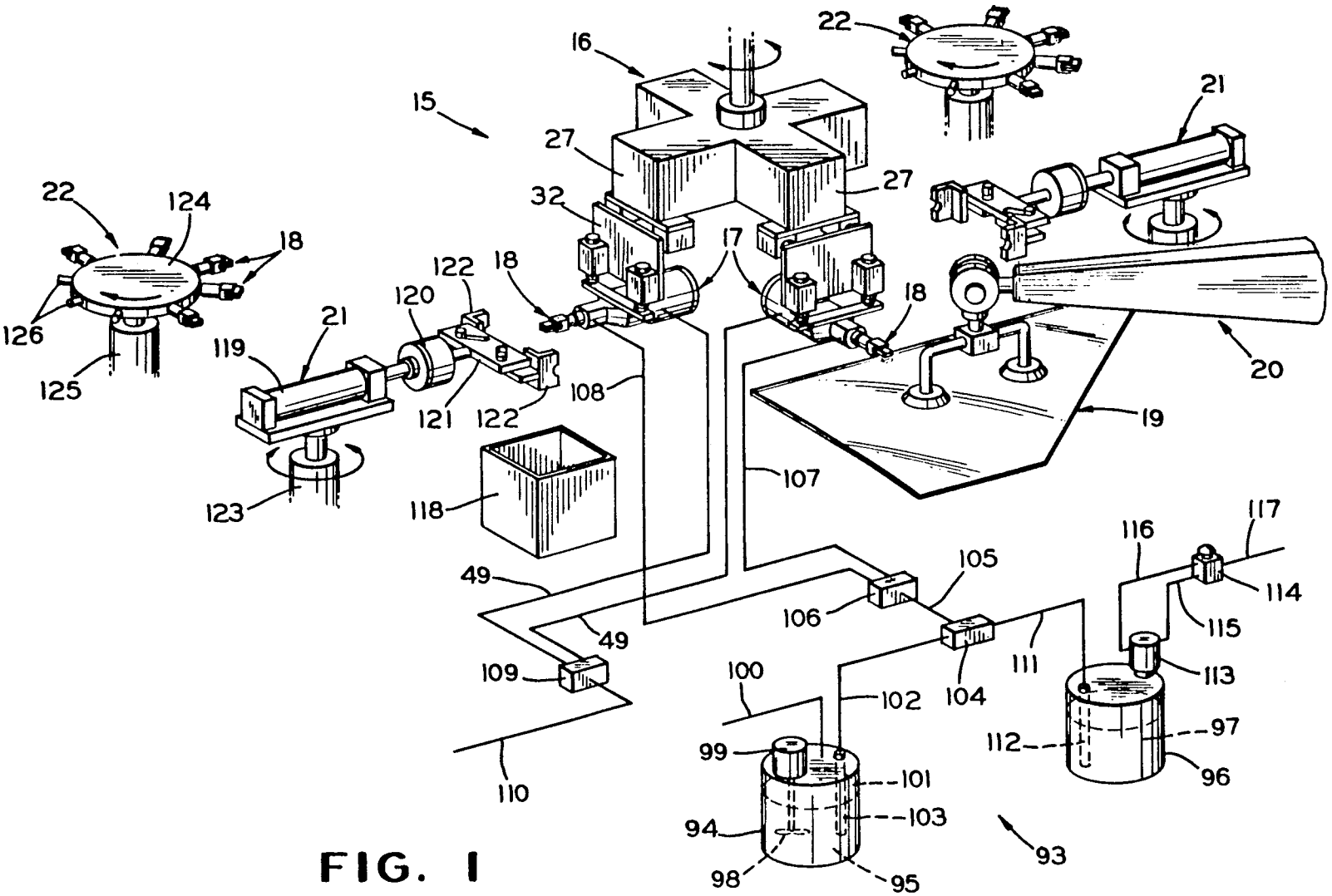
FIG. 1 is a schematic perspective view of a primer application system embodying the invention.

There is shown schematically in FIG. 1 an automated system constructed in accordance with the invention for applying a band, as of liquid prime material, to selected portions of the peripheral marginal surface or surfaces of a sheet member. More particularly the system, identified generally at 15, comprises a rotary carriage 16 upon which at least two applicator guns 17 are mounted at spaced intervals therearound. The applicator guns carry applicator tips 18 for applying a band of liquid primer material to the peripheral margins of a sheet member 19 carried therepast by a suitably controlled robotic arm 20 of conventional construction. There is associated with each applicator gun 17 a robot 21 operable to periodically remove the applicator tip 18 as it becomes worn and replace it with a new or refurbished tip taken from an adjacent carrousel 22.

Figure 2:
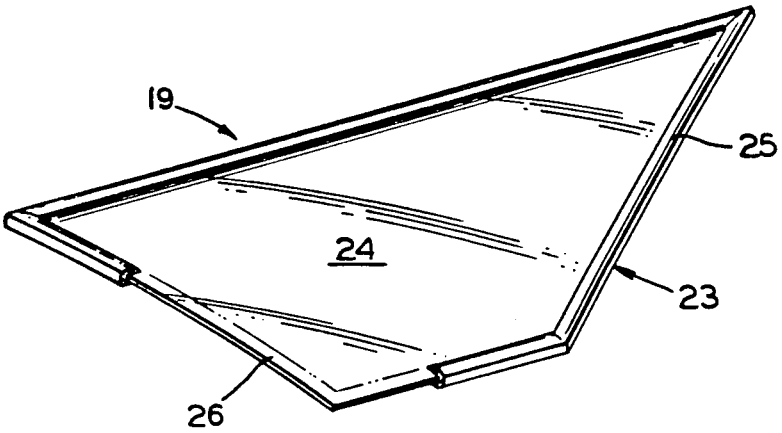
FIG. 2 is a perspective view of a sheet member or glazing unit having an encapsulating gasket, with portions of the gasket removed to illustrate a band of primer material applied in accordance with the invention.

As best seen in FIG. 2, the sheet member 19 may be a so-called encapsulated automobile glazing unit 23 comprising a transparent panel or sheet 24 upon a portion or all of whose peripheral margin a gasket member 25 is formed in situ as by a reaction injection molding process. Of course, the panel 24 may be a single sheet of glass, a plurality of such sheets laminated together, or an insulating glass unit comprised of two or more sheets secured together in spaced relationship around their peripheral margins. The panel may also, of course, be of a material other than glass. In any event, in order to promote and enhance adherence of the gasket member 25 to the panel 24, it is desirable to provide around the marginal surfaces of the panel prior to formation of the gasket member thereon a band 26 of primer material.

Figure 3:
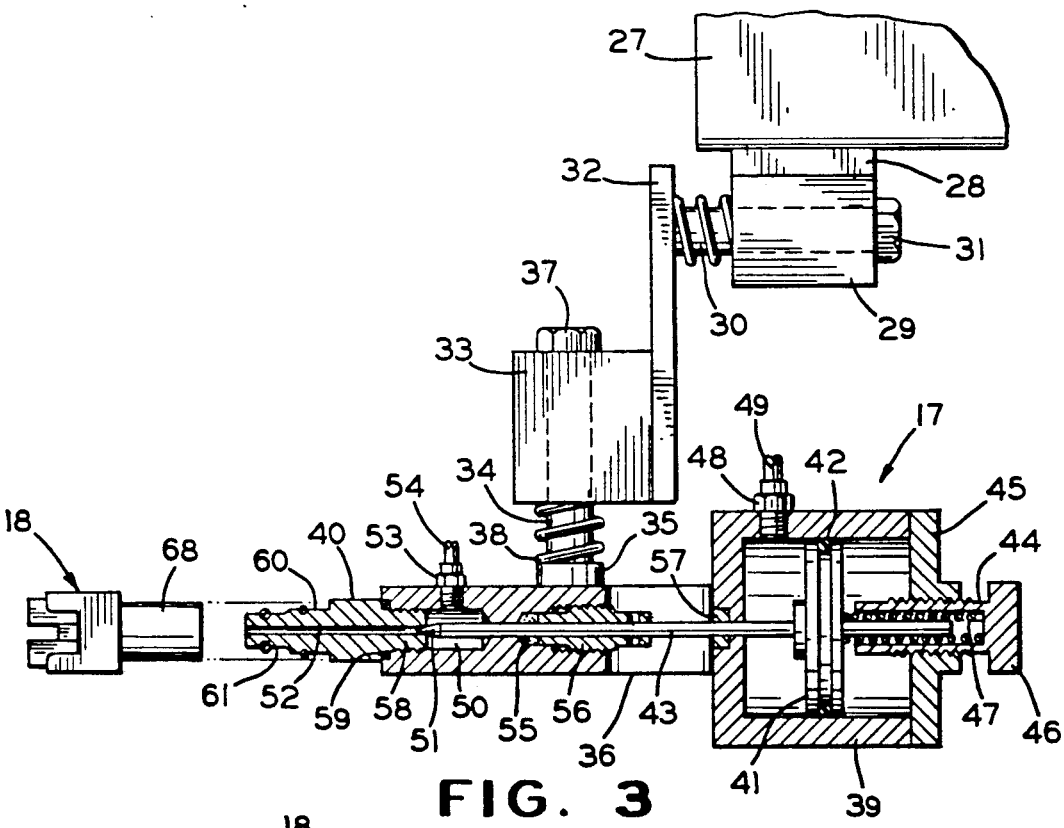
FIG. 3 is an enlarged fragmentary view, partially in section and partially exploded, or a portion of the carriage and a flow gun in accordance with the invention.
Figure 4:
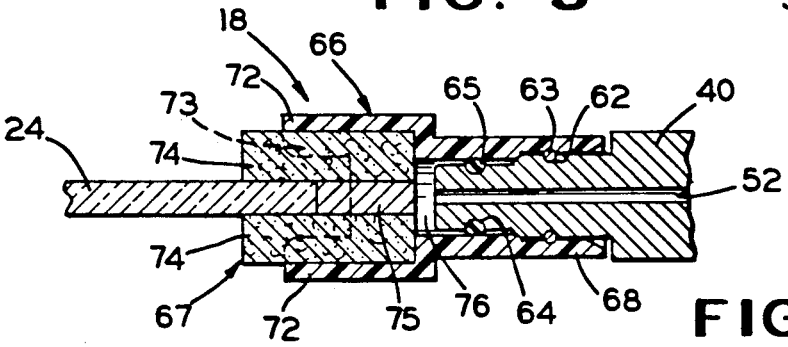
FIG. 4 is an enlarged, fragmentary, sectional view of an applicator tip in position to apply bands of priming material to marginal portions of the opposite surfaces of a sheet member.

As will hereinafter more fully explained, the applicator gun assemblies 17 are carried by the carriage 16 and suitably provided with supplies of primer material, cleaning solvent and compressed air. As best seen in FIGS. 3 and 4, the applicator guns are suspended from a support beam 27 comprising a part of the rotary carriage 16. In order to accommodate any misalignment with the sheets during operation, it is desirable that the applicator guns be resiliently mounted. To that end, there is provided on a mounting bar 28 beneath the support beam 27 a spaced pair of pillow blocks 29. Shafts 30, mounted for axial sliding movement within the pillow blocks, have a head 31 at one end and are affixed at their opposite end to a mounting plate 32. Compression springs 33 surrounding the shafts between the pillow blocks and the mounting plates resiliently urge the shafts and the mounting plate thereon to the forwardly advanced position illustrated in FIG. 3.

Second pairs of spaced pillow blocks 33 affixed to the mounting plate 32 have vertically oriented posts 34 mounted for axial sliding movement therethrough. The posts are affixed at their lower end by means of a collar 35 to the housing 36 of the applicator gun 17. The posts are provided at their upper end with heads 37 adapted to bear against the pillow blocks, and compression springs 38 surrounding the posts between the pillow blocks and the collars urge the vertical posts and the applicator guns thereon toward a lowered position as shown in FIG. 3.

The applicator guns 17 for supplying primer compound to the applicator tips 18 in a timed manner in predetermined amounts include an air cylinder 39 affixed to the rear of the housing 36, and a coupler member 40 affixed to the forward end thereof. There is reciprocally mounted within the air cylinder a piston 41 carrying an O-ring 42 in sliding, sealing engagement with the interior walls of the cylinder. An elongated needle 43 extends axially through the air cylinder, piston and gun housing so as to be advanced and retracted with the piston. An open ended adjusting sleeve 44 extends through the rear wall 45 of the air cylinder in threaded engagement therewith. An adjusting knob 46 is provided on its end for rotating the sleeve 44 to axially advance or retract it through the wall 45 to selected linear positions. The needle 43 extends behind the piston and into the adjusting sleeve. A compression spring 47 surrounding the needle 43 within the sleeve 44 acts between the piston and the rear of the sleeve to normally urge the piston forwardly. A fitting 48 in the wall of the cylinder ahead of the piston communicates, by means of a line 49, with a suitable controlled source of pressurized fluid as will be hereinafter described. Thus, by admitting pressurized fluid to the cylinder through the fitting 48, the piston may be retracted against the compression spring 37 to likewise retract the needle 43. Upon release of the pressurized fluid the piston will be returned to its normal advanced position by the spring 47.

At its forward end the needle 43 passes through a chamber 50 within the housing 36 and terminates in a tapered needle valve end 51 axially aligned with a passage 52 extending axially through the coupler member 40. With the needle in its normal advanced position, the tapered end 51 is received within the end of the passage 512 to seal off the passage and prevent flow of primer compound or solvent into the passage from the chamber 50 as will be hereinafter described. The chamber 50 is connected by means of a primer inlet 53 and primer line 54 to a suitably controlled pressurized supply of primer compound. A suitable packing ring 55 as of TEFLON® (registered trademark of E.I. duPont de Nemours and Company for synthetic resins based on tetrafluoroethylene polymers) and a threaded packing gland 56 conventionally provide a seal around the needle behind the chamber 50. A suitable seal 57 is likewise provided around the elongated needle at the end of the air cylinder 39.

The coupler member 40 is adapted to interchangeably receive any one of various embodiments of applicator tips 18 as will be hereinafter described and, in order to facilitate mechanized removal and replacement of the tips, is preferably provided with a telescoping quick-disconnect type coupling. The tips are adapted to be rotated about their longitudinal axis on the coupler member 40 so as to follow the surface contour of the peripheral margins of curved sheet members. More particularly, the coupler member includes a reduced end section 58 threadably received within the end of the gun housing 36 so that it can likewise be readily changed when necessary. A gasket member 59 is provided between the abutting ends of the housing and coupler members. At its other end, the coupler member is provided with a quick disconnect coupler arrangement and to that end is formed with first and second shank portions 60 and 61, respectively, of reduced diameter. In order to releasedly secure an applicator tip 18 in operative position as will be described, the first shank portion is provided with a circumferential groove 62 for receiving a snap or clip lock member 63 as best seen in FIG. 4. The second shank portion includes a circumferential groove 64 adapted to retain an O-ring 65.

The applicator tips 18, while taking various forms for different specific applications, are similar in basic construction. Likewise, it will be understood that while the tips are illustrated and described in conjunction with applicator guns of an automated system, they may as well be employed with manually operated applicator guns or hand held squeeze type dispensers provided with appropriate mating coupling means. Thus, each includes a pad block, identified generally at 66, for receiving and transmitting primer compound to a transfer pad member 67. The pad block may be of molded plastic or, where greater strength and durability may be desirable as in the embodiments of FIG. 9, may be of metal. In either case, the pad block includes a cylindrical coupling extension 68 having first and second interior segments 69 and 70 adapted to be telescopingly received over the first and second shank portions 60 and 61, respectively. The interior segments are of such diameters as to slip easily over the corresponding shank portions, and the first segment includes an annular recess 71 into which the lock ring 63 snaps with the applicator tip in the fully installed position on the coupler member 40. The O-ring 65 sealingly engages the interior wall of the second segment 70 to prevent primer material from leaking therepast as it is emitted through the passage 52.

As will be readily apparent in the views of the various embodiments, the end of the pad block 66 opposite the coupling extension 68 takes various forms suitable to accommodate the particular configurations of transfer pad members 67 utilized for applying bands of primer material in different configuration. Thus, in the embodiment of FIG. 4, for applying bands 26 of equal width to the marginal edges of both opposite surfaces of a sheet member, the pad block includes a pair of spaced, elongated legs 72 and opposite notched end panels 73 (only one shown) defining an open sided recess for retaining the transfer pad member. The pad member may comprise, as shown in FIG. 4, spaced pads 74 of porous wicking material such as felt or the like, affixed to opposite surfaces of a guide block 75, also generally of a porous, wicking material. The guide block is preferably of a durable, resilient, material so as to engage and slide along the edge of the sheet 24 as the applicator tip moves relative thereto and to serve as a depth gauge or guide for controlling the width of the bands applied to the sheet. The rear of the transfer pad member 677 is spaced from the end of the coupler member 40 so as to create a chamber 76 therebetween. Primer material is selectively delivered under pressure form the passage 52 to the chamber. The primer material, in turn, is forced into the porous felt pads 74 and guide block 75 for application to the surfaces of the sheet. As will be readily appreciated, the pads and guide blocks may be of various conventional material selected to provide the hardness, porosity, surface texture, etc., appropriate to the particular application for which they are to be used.

Figure 5:
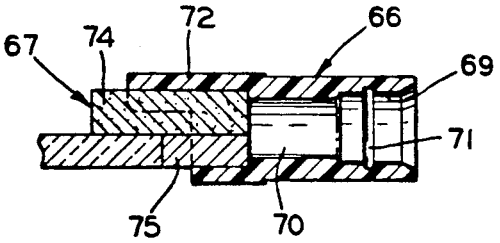
FIG. 5 is a longitudinal sectional view of an applicator tip in accordance with the invention for applying a narrow band of primer material to one marginal edge surface of a sheet.
Figure 6:
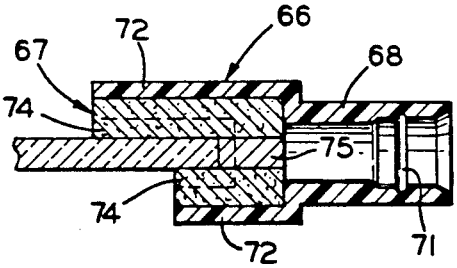
FIG. 6 is a longitudinal sectional view similar to FIG. 5 showing an applicator tip adapted to apply narrow bands of primer material of different widths to opposite surfaces of a sheet.

The applicator tips 18 as illustrated in FIGS. 5 and 6 are of the same basic construction as the embodiment of FIG. 4, the only difference being in adapting the construction for application of a band or bands of primer material to different marginal edge portions of a sheet. Thus, in the embodiment of FIG. 5 one of the legs 72 is shortened and the corresponding felt pad 74 is omitted. The guide block 75 is affixed to and extends beyond the shortened leg to engage the edge of the sheet 24, whereby the tip is particularly adapted for applying a band of primer material to one marginal edge surface. In the embodiment of FIG. 6, the pair of legs 72 and associated pads 74 are formed of unequal length whereby a wider band 26 is formed on one surface of the sheet than on the other.

Figure 7:
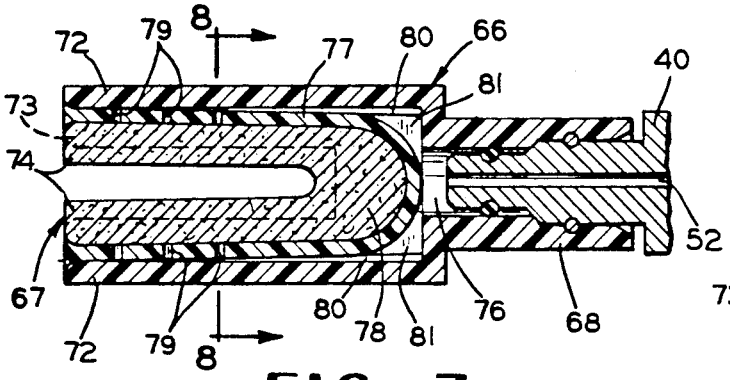
FIG. 7 is a longitudinal sectional view of an applicator tip for applying a wider band of primer material to opposite major marginal surfaces, as well as the edge, of a sheet.
Figure 8:
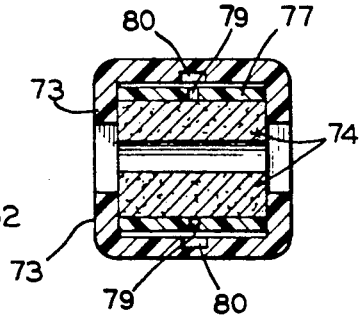
FIG. 8 is a sectional view taken substantially along line 8—8 of FIG. 7.

The embodiment of FIGS. 7 and 8 is particularly adapted to applying a relatively wide band of primer material to both marginal surfaces, as well as the edge of a sheet. To that end, the legs 72 of the pad block 66 are of somewhat greater length so as to receive therein a generally U-shaped insert 77, also preferably of a porous, wicking material. The transfer pad member 67, comprising a pair of the spaced felt pads 74 interconnected by a web 78, is similarly U-shaped and is fixedly received within the porous insert 77. In order to assure a supply of the primer material to the felt pads at the remote or open end of the transfer pad member 67, the insert 77 is provided with a series of spaced, longitudinally aligned openings 79 as along the longitudinal axis of the insert. As best seen in FIG. 8, the openings communicate with tapered slots 80 extending longitudinally along the interior walls of the pad block. The slots taper in depth from a maximum at the rear to a minimum depth at their termination at the most remote of the openings 79 to apportion the flow of primer material and assure that an excess of such material does not reach the exposed end of the felt. The rounded configuration at the rear of the U-shaped insert 77 abuts the end of the coupling extension 68, forming cavities 81 providing communication between the chamber 76 and the slots 80. Thus, as primer material is admitted to the cavities 81 under pressure it will travel through the porous insert and along the slots 80 and be distributed through the openings 79 to provide a substantially uniform supply to the transfer pad member 67 for wiping onto the surface margins and edge of a panel or sheet as it is advanced through the gap between the felt pads 74. AT the open end of the tip, the pads 74 are sealed within the insert 77 and the insert is sealed within the legs 72 of the pad block 66 to prevent loss of primer material.

Figure 10:
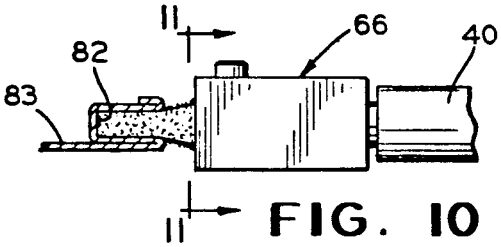
FIG. 10 is a side view of the embodiment of FIG. 9, showing the tip in position for applying primer material to the interior surfaces of a channel-shaped member.
Figure 9:
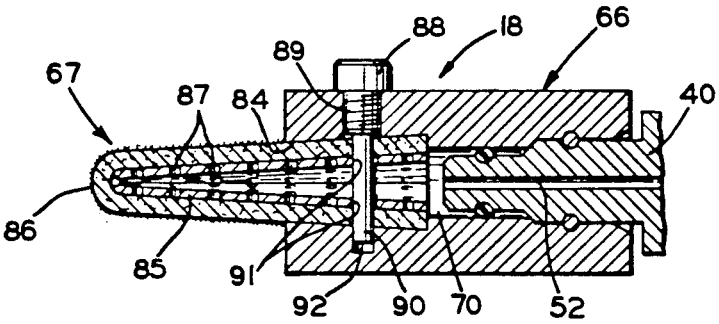
FIG. 9 is a longitudinal sectional view of an embodiment of the applicator tip adapted to apply primer material to interior surface between spaced sheet members.
Figure 11:
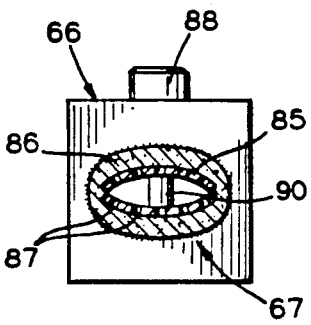
FIG. 11 is a transverse sectional view taken substantially along line 11—11 of FIG. 10.

As best seen in FIG. 10, the embodiment of FIGS. 9, 10 and 11 is particularly adapted for providing a coating of primer material on the interior surfaces of a channel-shaped member. More particularly, the applicator tip may be utilized for application of primer material within a channel 82 as of a fabricated sheet metal or molded plastic part 83, or it may be used for applying the primer material to the inner marginal portions of opposed, spaced sheets of glass as in a multiple glass sheet glazing unit. Inasmuch as the applicator tips project into the recesses and may be subjected to substantial stress as the workpiece moves therepast, it may be desirable to construct them somewhat differently from the previously described embodiments. To that end, the pad block 66 may be fabricated of a suitable metal so as to accommodate a replaceable transfer pad member 67. More particularly, the pad block is provided at the end of the coupling extension segment 70 with an oval or elliptically shaped passage 84 which converges slightly from the segment 70 toward the remote end of the pad block. The pad member is of a configuration adapted to be complementarily received within the passage 84, and to that end comprises a tapered tubular insert 85 covered by a sleeve 86 as of the aforementioned porous, wicking felt material. The tubular insert is preferably of a somewhat resilient flexible material, with its open end in communication with the tubular interior of the pad block. The insert tapers down to comprise a closed tip at its other end, and openings 87 are disposed at spaced intervals over the tubular insert 85 to provide communication between the interior of the insert and the sleeve 86. The openings thus assure that as primer material is admitted to the interior of the pad block under pressure, the sleeve will be provided with a continuing supply of primer material over its entire area.

As indicated above, the pad block 66 is preferably formed of a stronger, more durable material than are the pad blocks of the previously described embodiment. Its cost may thus preclude discarding the entire applicator tip assembly 18 when the sleeve 86 becomes worn. To that end, the transfer pad assembly 67 is constructed so that is can be readily removed from the pad block for replacement. The transfer pad assembly may then be discarded, or the worn sleeve 86 may be removed and replaced by a new sleeve. As indicated above, the end of the transfer pad member 67 is of a configuration to be complementarily received within the end of the pad block 66. A locking pin 88 includes a shank portion 89 threadably received in one wall of the pad block, and a shaft 90 extending through aligned openings 91 in the transfer pad member and into a recess 92 in the opposite wall of the pad block. Thus, by removing the locking pin, the transfer pad member 67 can be withdrawn from the pad block. The transfer pad member is sufficiently flexible that the end of a new or rebuilt unit can be manually depressed and inserted axially into the pad block until its end engages the lip defining the end of the oval shaped passage 84. The locking pin 99 is then reinserted through the openings 91 in the transfer pad member and tightened down to securely lock the transfer pad in operative position.

As indicated above and as will be readily appreciated, while the aforedescribed applicator tips are particularly well suited to use with automated systems for applying bands of primer material to the peripheral margins of sheets of material, they likewise find utility in the manual application of such materials. Thus, for example, the applicator guns 17 may be of a hand gun type connected to a central supply and manually manipulated to apply the bands around a stationary sheet, or the sheet may be manually moved past a stationary applicator gun. The tips may even be employed on a conventional squeeze bottle dispenser (not shown) containing a supply of the primer compound for applying bands to small numbers of sheets.

In accordance with the preferred embodiment shown schematically in FIG. 1, the system is set up for application of bands 26 to one sheet at a time at a single work station. Thus, the rotary carriage 16 carries two applicator guns 17 and is adapted to periodically oscillate back and forth to move the guns between a work station and an applicator tip changing station. It will be understood that the rotary carriage may as well carry one or more additional pairs of applicator guns for servicing a like additional number of work stations disposed around the rotary carriage. Likewise, it is contemplated that for application of different types of bands along different peripheral marginal portions of a sheet, the sheet may be treated at a plurality of work stations, or the rotary carriage may be provided with a number of applicator guns 17 having the requisite applicator tips 18 and moveable into position for sequentially applying the different bands at a single work station.

It may be desirable to apply various types of primer material as dictated by the gasket member 25 to be formed, or other end use of the sheet having the band thereon. The primer may, for example, comprise a silane material with or without an identifying dye, which is relatively simple to handle within the system 15, or a so-called black primer which includes an isocyanurate urethane heavily laden with carbon black in very volatile solvents, which is much more difficult to handle and apply within the system. Thus, the black primer must be constantly agitated to prevent the carbon black from dropping out of suspension, and must be contained within an enclosed receptacle beneath a blanket of neutral gas such as nitrogen to prevent evaporation of the solvent and/or an iso reaction with moisture-laden air. Furthermore, the delivery system should periodically be flushed with solvent to remove accumulated deposits of the primer from the feed hose lines, applicator guns and applicator tips. The system particularly needs to be flushed before extended periods of non-use to purge it of the primer material. Due to its low viscosity, suitable flow restrictions may be employed within the flow path when applying silane based primer materials.

In order to suitably provide the primer material in accordance with the aforementioned requirements, there is provided a primer supply system, illustrated generally at 93 in schematic form in FIG. 1. The supply system more particularly includes an enclosed receptacle 94 for containing a supply of the primer material 95 under pressure and a second enclosed receptacle 96 for containing a supply of the solvent 97 under pressure. An impeller blade 98 driven by a suitable motor 99 is provided for agitating the primer material within the receptacle 94 to prevent settling of the suspended solids. A line 100 delivers an inert gas such as nitrogen at a suitably controlled pressure from an appropriate source (not shown) for maintaining a plenum of the gas in a headspace 101 above the primer material. The inert gas prevents reaction of the primer material due to the presence of ambient atmosphere, and pressurizes the receptacle for delivering the primer material to the applicator guns as will be hereinafter described.

In order to deliver primer material to the applicator guns 17, a line 10 connected to a collection tube 103 within the receptacle 94 carries primer material from the pressurized supply 95 to a three-way valve 104. The valve 104 is connected by means of a second line 105 to a two-way distributor valve 106 which, in turn, selectively directs material from the line 105 to one or the other of the applicator guns 17 through delivery lines 107 and 108 extending from the distributor valve to a corresponding gun. It will, of course, be understood that the system may be expanded to accommodate additional applicator guns on the rotary carriage 16 as desired. Likewise, it will be readily appreciated that the applicator guns to which delivery lines are connected may be hand held for manual application of the band 26 of primer material to the sheet members.

In order to selectively operate the pistons 41 within the cylinders 39, the lines 49 are connected to a selector valve 109. The selector valve, in turn, is connected by means of a line 110 to a suitably controlled source (not shown) of pressurized air. Thus, by coordinating operation of the valves 104 and 109 liquid material, either primer material or solvent, may be selectively transmitted through the applicator guns 17 to the applicator tips 18 in suitably controlled amounts.

In order to supply the solvent 97 for flushing the primer material from the applicator guns and tips upon demand, a line 111 connects the three-way valve 104 to a collection tube 112 within the second enclosed receptacle 96. A pressure relief sequence valve 113 affixed to the receptacle 96 is connected to a push button valve 114 by means of a supply line 115 and a pressure relief line 116. The push button valve, in turn, is connected by means of a line 117 to a suitable source (not shown) of compressed air.

In operation, whenever the applicator guns 17 are to be operated following a shutdown period and primer material is to be dispensed to the applicator tips 18, the three-way valve 104 is opened to the primer dispense position to direct primer through the hose and applicator guns. After any solvent has been purged from the gun and primer material begins to be discharged therefrom, the needle end 51 is advanced to close the passage 52. A selected applicator tip 18 is affixed to the coupler member 40 in readiness for applying bands 26 of primer material. In order to prepare the system for an extended shut down period following a production run, the three-way valve 104 is turned to the flush position, and the push button valve 114 is depressed. The applicator guns are, in turn, triggered for flow and solvent from the receptacle 96 and is directed through the hoses, applicator gun and applicator tip to flush the primer therefrom. The material flushed from the system is dispensed into a receptacle 118 beneath the applicator tip. When the primer has been purged from the system, the palm push button 114 is released, allowing the air to be relieved from the tank and depressurizing the system. The depressurization serves as a safety measure in that the receptacle 96 is at ambient pressure and no solvent can leak into the primer circuit. The three-way valve 104 is then turned to the off position, and the system is shut down. Where there is to be a prolonged period of shutdown, the applicator tip is removed. For shorter periods, where the system is to be reactivated within several hours, it may be left in place. It will be understood, of course, that the start-up and shut-down procedures may be programmed for automatic operation.

The robot 21 and carrousel 22 for installing applicator tips and removing them from the applicator guns are, as shown schematically in FIG. 1, of a generally standard construction, adapted to handle the particular parts. As will be readily apparent, other suitable apparatus may be employed in exchanging the applicator tips. Thus, the robot 21 includes a barrel 119 from which an arm 120 advances and retracts. The arm includes a hand 121 having opposed fingers 122 adapted, when the arm is advanced, to pivot to a closed position and clampingly engage an applicator tip 18 around the pad block 66. Thereafter the arm is retracted to axially remove the pad block from the coupler member 40.

The barrel 119 is mounted upon a pedestal 123 for reciprocable swinging movement about a vertical axis.

Thus, when the arm 120 has been retracted with the fingers 122 carrying a spent applicator tip 18, the barrel and arm swing, in the manner indicated by the arrow in FIG. 1, to bring the applicator tip into a position adjacent the carrousel 22. The carrousel includes a rotary plate 124 mounted upon a pedestal 125 for rotation about a vertical axis in a sequential manner as indicated generally by the arrow. The rotary plate carries a plurality of spaced, radially extending pegs 126 adapted to be moved seriatim into axial alignment with the arm 120. The pegs are configured to have an end equivalent to the tip of the coupler member 40 so as to similarly be received in the coupling extension 68 of an applicator tip 18. Thus, when the arm 120 carrying a spent applicator tip has been aligned with an empty peg 126, the arm advances and installs the tip on the peg. Thereafter, the fingers 122 are withdrawn to release the applicator tip and the arm 120 is retracted. The rotary plate 124 is cycled to advance a peg 126 on which a new or refurbished applicator tip has been installed into alignment with the arm 120. The sequence of stops is then repeated in reverse order to install the tip on the coupler member 40.

While the applicator tip is being changed, the other of the applicator guns 17 has been in operative position for applying a band of primer to the sheet. When the tip of that gun is no longer usable, the carriage 16 rotates to bring the gun with the newly installed tip into operative position, while the gun with the spent tip is moved into position for changing by the other of the carrousels 22.

It is to be understood that the forms of the invention herewith shown and described are to be taken as illustrative embodiment only of the same, and that various changes in the shape, size and arrangement of the parts, as well as various procedural changes, may be resorted to without departing from the spirit of the invention.

We claim:

1. Apparatus for applying a band of liquid material to at least one peripheral marginal surface of a sheet of material comprising, dispensing means for containing and selectively dispensing a liquid material, a coupler member on said dispensing means, and an applicator tip including a coupling extension adapted for releasably mating with said coupler member and placing said applicator tip in fluid communication with said dispensing means, said applicator tip being adapted to receive said liquid material from said dispensing means and deposit a band of said liquid material in response to movement of said applicator tip relative to and in wiping contact with a peripheral marginal surface of a sheet of material, said applicator tip comprising a hollow, open-sided pad block member affixed to said coupling extension, the interior of said pad block member being in fluid communication with said coupling extension, and a transfer pad affixed within the hollow interior of said pad block member for receiving said liquid material from said dispensing means, said transfer pad comprising a porous, wicking material adapted for said wiping contact with said sheet surface for receiving said liquid material and depositing said band of material on said sheet surface, and including a guide block positioned within said pad block member for slidingly engaging an edge of said sheet as the applicator tip and sheet are moved relative to one another.

2. Apparatus for applying a band of liquid material as claimed in claim 1, including a plurality of said applicator tips adapted to interchangeably mate with said coupler member, each of said applicator tips being of a structure adapted to apply a said band distinct from a said band applied by another of said applicator tips.

3. Apparatus for applying a band of liquid material claimed in claim 1, including lock means releasably securing said coupling extension and said coupler member in a selected axial position relative to one another, and sealing means between said coupling extension and said coupler member.

4. Apparatus for applying a band of liquid material as claimed in clam 3, wherein said lock means comprises a ring member for seating in opposed circumferential recesses in said coupling extension and said coupler member whereby said applicator tip is adapted for snap fitting on said dispensing means.

5. Apparatus for applying a band of liquid material as claimed in claim 3, wherein said sealing means comprises an O-ring seated in a circumferential recess in one of said coupling extension and coupler member and bearing circumferentially against the other one thereof.

6. Apparatus for applying a band of liquid material as claimed in clam 1, wherein said transfer pad comprises a pad member adjacent to and extending outwardly beyond said pad block member for engaging a major peripheral surface of said sheet while said guide block engages the edge thereof.

7. Apparatus for applying a band of liquid material as claimed in claim 6, wherein said transfer pad comprises a spaced pair of said pad members, said guide block being disposed intermediate said pad members whereby a said band is applied to both major peripheral marginal surfaces of said sheet.

8. Apparatus for applying a band of liquid material as claimed in claim 7, wherein one pad member of said spaced pair extends a greater distance beyond said pad block member than the other.

9. Apparatus for applying a band of liquid material as claimed in claim 1, wherein said dispensing means includes a receptacle having an enclosed interior adapted to be selectively pressurized for discharging said liquid material to said applicator tip.

10. Apparatus for applying a band of liquid material as claimed in claim 1, wherein said dispensing means comprises an applicator gun, said applicator gun being connected to a source of said liquid material maintained under pressure, and said applicator gun including a valve member actuable to discharge said liquid material to said applicator tip.

11. Apparatus for applying a band of liquid material as claimed in claim 10, wherein said applicator gun includes a housing, a chamber in said housing connected to said source of liquid material under pressure, said coupler member being affixed to said housing and in fluid communication with said chamber, said valve member including an elongated needle valve member extending axially through said housing and being axially moveable between open and closed positions, said needle valve member preventing flow of said liquid material from said chamber to said coupler member in said closed position, spring means urging said needle valve member to said closed position, and piston means connected to said needle valve member selectively operable to retract said needle valve member against said spring mean whereby said liquid material is discharged from said chamber to said coupler member and applicator tip.

12. Apparatus for applying a band of liquid material as claimed in claim 1, including a carriage mounted for rotary movement, said dispensing means comprising an applicator gun mounted on said carriage and connected to a source of said liquid material maintained under pressure, said applicator gun including a valve member actuable to discharge said liquid material to said applicator tip, sheet carrying means for supporting said sheet in operative position to engage said applicator tip, and means providing relative movement between said sheet and said applicator tip whereby said band is deposited on said marginal surface.

13. Apparatus for applying a band of liquid material to at least one peripheral marginal surface of a sheet of material comprising, dispensing means for containing and selectively dispensing a liquid material, a coupler member on said dispensing means, and an applicator tip including a coupling extension adapted for releasably mating with said coupler member and placing said applicator tip in fluid communication with said dispensing means, said applicator tip being adapted to receive said liquid material from said dispensing means and deposit a band of said liquid material in response to movement of said applicator tip relative to and in wiping contact with a peripheral marginal surface of a sheet of material, said applicator tip comprising a hollow, open-sided block member affixed to said coupling extension, the interior of said pad block member being in fluid communication with said coupling extension, and a transfer pad affixed within the hollow interior of said pad block member for receiving said liquid material from said dispensing means, said transfer pad comprising a porous wicking material adapted for said wiping contact with said sheet surface for receiving said liquid material and depositing said band of material on said sheet surface, said transfer pad comprising a U-shaped pad member including spaced legs interconnected by a web for receiving the peripheral marginal edge of said sheet therein.

14. Apparatus for applying a band of liquid material as claimed in claim 13, including a U-shaped insert within said pad block member, said U-shaped pad member being disposed within said U-shaped insert.

15. Apparatus for applying a band of liquid material as claimed in claim 14, wherein said U-shaped insert comprises a spaced pair of legs disposed along interior surfaces of said pad block member, a plurality of openings extending through at least one of said legs of said insert, and an elongated slot in a wall of said pad block member in communication with said openings for delivering said liquid material from said coupling extension through said openings to said transfer pad.

16. Apparatus for applying a band of liquid material to at least one peripheral marginal surface of a sheet of material comprising, dispensing means for containing and selectively dispensing a liquid material, a coupler member on said dispensing means, and an applicator tip including a coupling extension adapted for releasably mating with said coupler member and placing said applicator tip in fluid communication with said dispensing means, said applicator tip being adapted to receive said liquid material from said dispensing means and deposit a band of said liquid material in response to movement of said applicator tip relative to and in wiping contact with a peripheral marginal surface of a sheet of material, said applicator tip comprising a pad block member including said coupling extension and having a passage extending longitudinally therethrough in communication with said coupling extension, a perforate tubular insert having an open end received within said passage and a closed end projecting outwardly beyond said pad block member, and a sleeve of porous, wicking material covering said insert.

17. Apparats for applying a band of liquid material as claimed in claim 16, wherein said passage is of tapered oval cross-section, said insert being of corresponding oval cross-section for reception in said passage and tapering inwardly from said passage to said closed end.

18. Apparatus for applying a band of liquid material as claimed in claim 17, including a plurality of spaced openings disposed over said tubular insert and extending therethrough for delivering said liquid material from said coupling extension to said sleeve.

19. Apparatus for applying a band of liquid material as claimed in claim 17, wherein said tubular insert is separable from said pad block member, including locking means releasably securing said tubular insert to said pad block member.

20. Apparatus for applying a band of liquid material to at least one peripheral marginal surface of a sheet of material comprising, dispensing means for containing and selectively dispensing a liquid material, a coupler member on said dispensing means, and an applicator tip including a coupling extension adapted for releasably mating with said coupler member and placing said applicator tip in fluid communication with said dispensing means, said applicator tip being adapted to receive said liquid material from said dispensing means and deposit a band of said liquid material in response to movement of said applicator tip relative to and in wiping contact with a peripheral marginal surface of a sheet of material, including a carriage mounted for rotary movement, said dispensing means comprising an applicator gun mounted on said carriage and connected to a source of said liquid material maintained under pressure, said applicator gun including a valve member actuable to discharge liquid material to said applicator tip, sheet carrying means for supporting said sheet in operative position to engage said applicator tip, and means providing relative movement between said sheet and said applicator tip whereby a band of said liquid material is deposited on said marginal surface, a carousel removably carrying a plurality of said applicator tips, and an arm including grasping means programmed to detach a first said applicator tip from said applicator gun and deposit it on said carousel and to retrieve a second said applicator tip from said carousel and attach it to said applicator gun in place of said first applicator tip.

21. Apparatus for applying a band of liquid material as claimed in claim 20, including a second said applicator gun on said carriage, and second ones of said arm and said carousel operatively associated with said carriage and said second applicator gun, said carriage being operable to selectively move either of the first and second applicator guns into operative relationship relative to said sheet carrying means.

22. Apparatus for applying a band of liquid material as claimed in claim 20, wherein said source of liquid material comprises a first enclosed receptacle for containing a supply of said liquid material, impeller means for stirring said liquid material in said first enclosed receptacle, an inert atmosphere supply means for maintaining an inert atmosphere over said liquid material in said first receptacle, a second enclosed receptacle in which a supply of cleaning solvent is maintained, and valve and piping means selectively connecting said first and second receptacles to said applicator gun whereby said liquid material and said solvent are selectively supplied to said applicator gun.

* * * * *